US008083071B2

(12) United States Patent
Svoronos et al.

(10) Patent No.: US 8,083,071 B2
(45) Date of Patent: Dec. 27, 2011

(54) ROTATING CONE CLASSIFIER

(75) Inventors: Spyros A. Svoronos, Gainesville, FL (US); Dongchul Lee, Daejeon (KR); Hassan El-Sayed El-Shall, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 8 days.

(21) Appl. No.: 12/306,414

(22) PCT Filed: Jul. 16, 2007

(86) PCT No.: PCT/US2007/073600

§ 371 (c)(1),
(2), (4) Date: Sep. 10, 2009

(87) PCT Pub. No.: WO2008/009019

PCT Pub. Date: Jan. 17, 2008

(65) Prior Publication Data

US 2010/0176036 A1 Jul. 15, 2010

Related U.S. Application Data

(60) Provisional application No. 60/830,844, filed on Jul. 14, 2006.

(51) Int. Cl.
*B07B 7/08* (2006.01)

(52) U.S. Cl. ..... 209/150; 209/139.2; 209/148; 209/915

(58) Field of Classification Search ..... 209/134, 209/135, 139.2, 146, 148, 149, 150, 915; 494/50, 55, 56
See application file for complete search history.

(56) References Cited

U.S. PATENT DOCUMENTS

| | | | | |
|---|---|---|---|---|
| 1,746,686 | A * | 2/1930 | Sturtevant | 209/139.2 |
| 2,501,179 | A * | 3/1950 | Komline | 494/41 |
| 3,960,714 | A * | 6/1976 | Strauss | 209/139.2 |
| 4,388,183 | A * | 6/1983 | Thomas | 209/139.2 |
| 4,409,097 | A | 10/1983 | Barthelmess | |
| 6,126,587 | A * | 10/2000 | Berger et al. | 494/55 |
| 6,827,221 | B1 * | 12/2004 | Brundiek et al. | 209/210 |
| 2003/0221996 | A1 | 12/2003 | Svoronos et al. | |

FOREIGN PATENT DOCUMENTS

| | | |
|---|---|---|
| WO | WO 96/35521 | 11/1996 |

* cited by examiner

*Primary Examiner* — Joseph C Rodriguez
(74) *Attorney, Agent, or Firm* — Saliwanchik, Lloyd & Eisenschenk

(57) ABSTRACT

A classifier includes a central particle inlet, an inclined feed surface, and a classification surface. A plurality of particle feeding vanes are positioned above the feed surface, and the plurality of particle feeding vanes rotate above the feed surface. A plurality of classification vanes are positioned above the classification surface, and the plurality of classification vanes rotate above the classification surface. Particles enter the classifier through the inlet near an axis of rotation and flow radially outward on the feed surface to the classification surface.

9 Claims, 20 Drawing Sheets

(a) top view (b) side view

ROTATING CONE CLASSIFIER

CROSS-REFERENCE TO A RELATED APPLICATION

This application is a National Stage Application of International Application Number PCT/US2007/073600, filed Jul. 16, 2007; which claims the benefit of U.S. provisional application Ser. No. 60/830,844, filed Jul. 14, 2006, and are incorporated herein by reference in their entirety.

GOVERNMENT SUPPORT

This invention was made with government support under a grant awarded from the National Science Foundation under grant number EEC-9402989. The government has certain rights in the invention.

BACKGROUND

Air classifiers are most commonly used for separating coarse from fine particles. Most classifiers use the combined action of drag and centrifugal forces to separate materials of different diameter or density. The drag force is generated by the flow of air and the centrifugal force is produced by rotating the air flow in some manner.

Demanding applications for classification can be found in the chemical, food, ceramics, electronics, and pharmaceuticals industries, where narrow particle size distributions are desired. Many natural minerals and chemical raw materials can be used in new applications with improved economy when they are turned into fine powders. The size of the fines is determined by requirements of the product application.

A conventional rotating vane classifier consists of a cylinder with a rotor, which turns radial vanes. The vanes extend only a limited distance to the axis to avoid particle clogging. Particles are fed to the classifier near the outer radius, perpendicular to the radial air stream. When air flow passes through the vanes, it is given a tangential velocity component. Particles above the cut size are collected at the periphery of the classifier due to the centrifugal force, while those below the cut size are carried with the air to the center of the classifier due to the drag force, where they exit, as shown in FIG. 1. For larger particles, the centrifugal force is predominant because it is proportional to $d_p^3$ while the drag force is proportional to $d_p$, where $d_p$ is the particle diameter; consequently they tend to be collected to the outside of the vanes. If the drag force acting on a particle is greater than the centrifugal force, the particle will pass through the vanes and will be collected into the fine fraction. Otherwise it will be rejected by the rotating vanes and go to the coarse fraction. The flow within the vanes where particles are separated is a forced vortex, and it will provide sharper cuts compared to other air classifiers without rotating vanes, such as cyclone separators and cross-flow air classifiers.

Rotating vane classifiers have been widely used to separate particles according to size in industries because they provide not only low cut size but also high cut sharpness. But they have a significant disadvantage in that particles are fed to the outside of the fast rotating vanes, which can cause particle attrition and deteriorate classification performance.

The cut size of particles depends on various parameters of the classifier, such as rotor shape, the number of blades, rotor speed, feed rate and airflow.

SUMMARY

A classifier includes a central particle inlet, an inclined feed surface, and a classification surface. A plurality of particle feeding vanes are positioned above the feed surface, and the plurality of particle feeding vanes rotate above the feed surface. A plurality of classification vanes are positioned above the classification surface, and the plurality of classification vanes rotate above the classification surface. Particles enter the classifier through the inlet near an axis of rotation and flow radially outward on the feed surface to the classification surface.

In an exemplary embodiment, the feed surface is inclined at an angle of about 5 to 25 degrees with respect to the classification surface. In one embodiment this angle is about 5 to 15 degrees. Specifically exemplified is an angle of about 10 degrees. Another embodiment further includes a particle dispersion mechanism. In an exemplary embodiment, the particle dispersion mechanism includes a plurality of strings attached to a rotating shaft at the inlet. In one embodiment, the number of feeding vanes equals a number of classification vanes.

One embodiment comprises the use of a barrier that prevents a direct path from the feeding vanes to the coarse exit.

The above summary is not intended to describe each illustrated embodiment or every implementation of the present invention. The figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which:

FIG. 6*b* is a perspective view of an exemplary embodiment of a rotating cone classifier of the present disclosure with the cover on.

DETAILED DESCRIPTION

Figure 1:
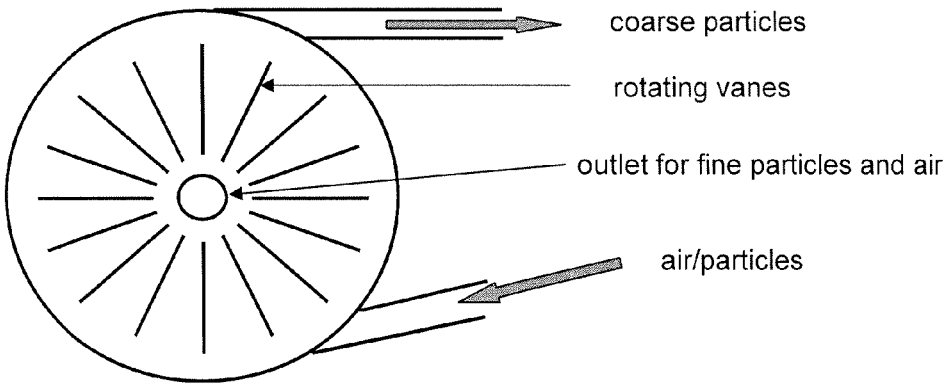
FIG. 1 (prior art)
FIG. 1 illustrates a conventional rotating vane classifier.
Figure 1:
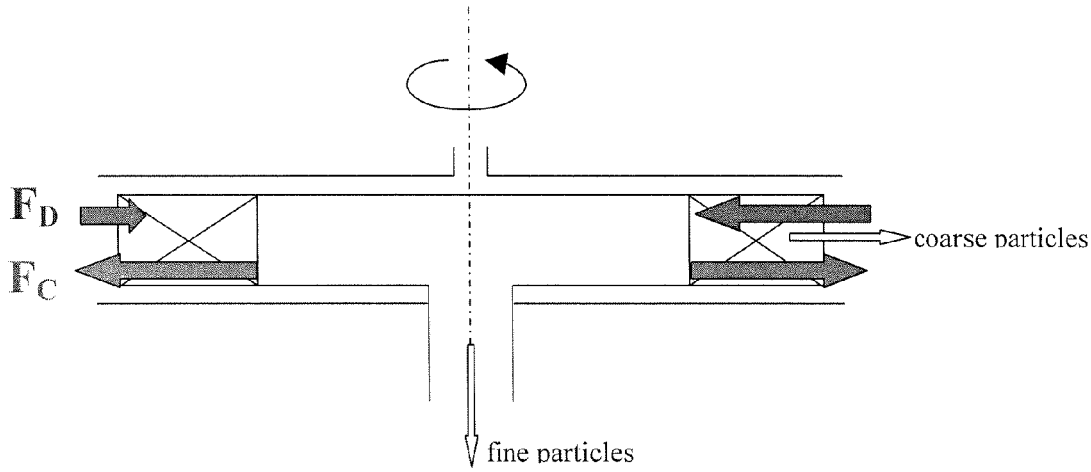
FIG. 1 (prior art)
Figure 2:
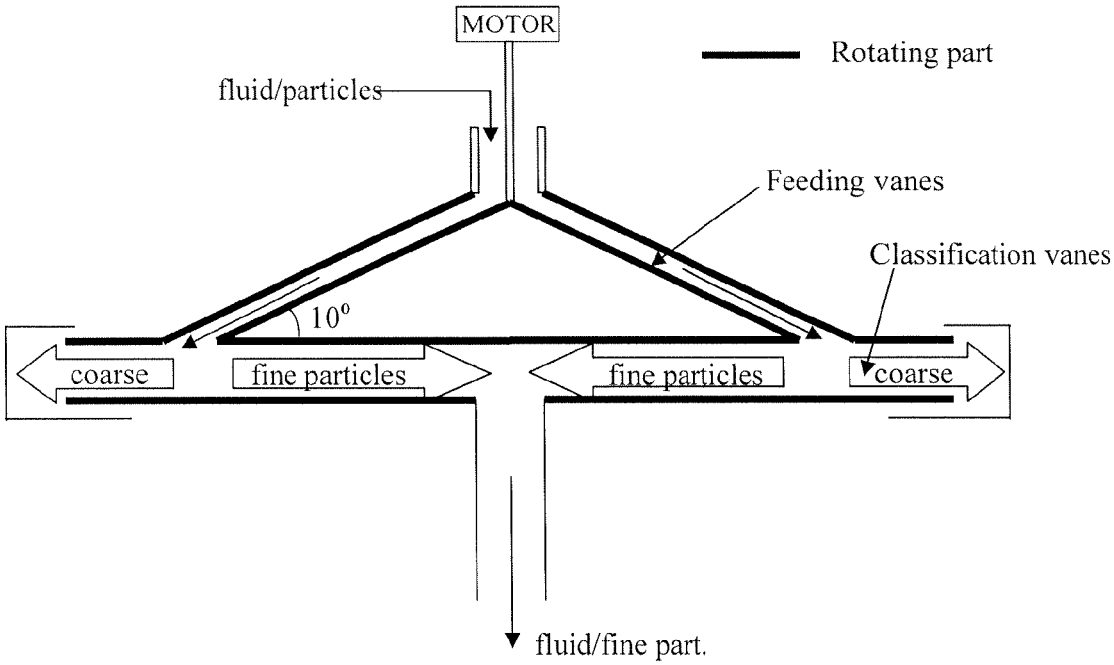
FIG. 2 is a schematic diagram of an exemplary embodiment of a rotating cone classifier of the present disclosure.
Figure 3:
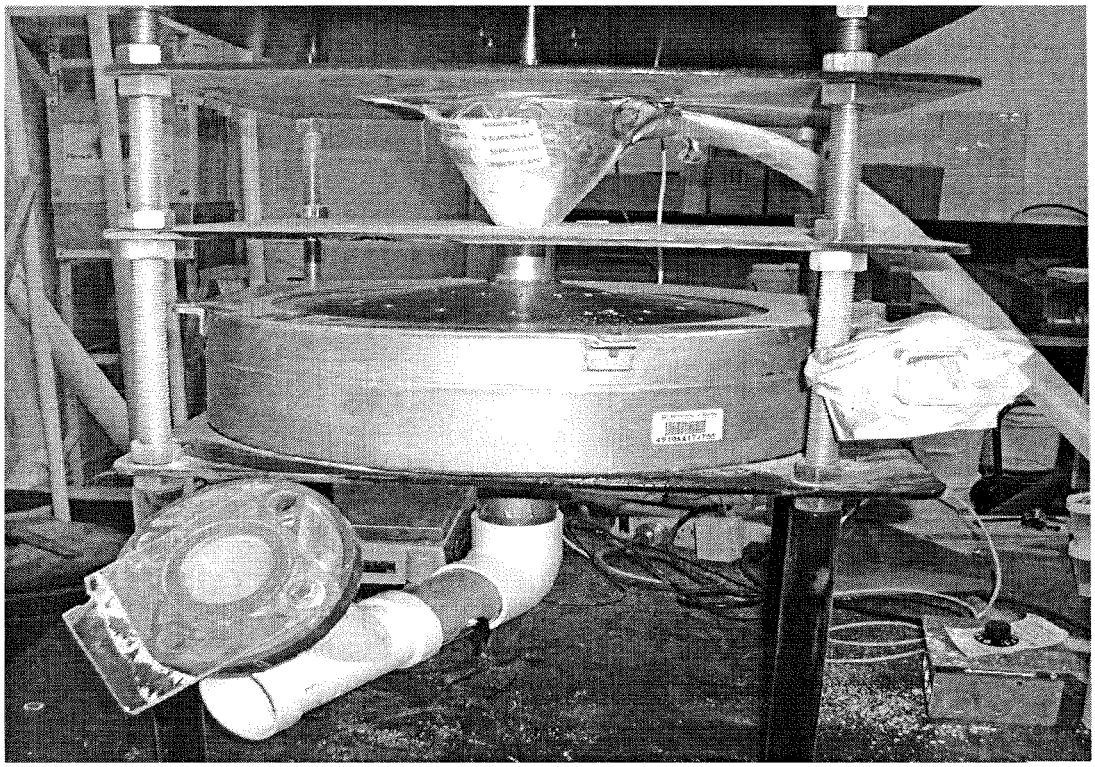
FIG. 3 is a photograph of an exemplary embodiment of a rotating cone classifier of the present disclosure.
Figure 4:
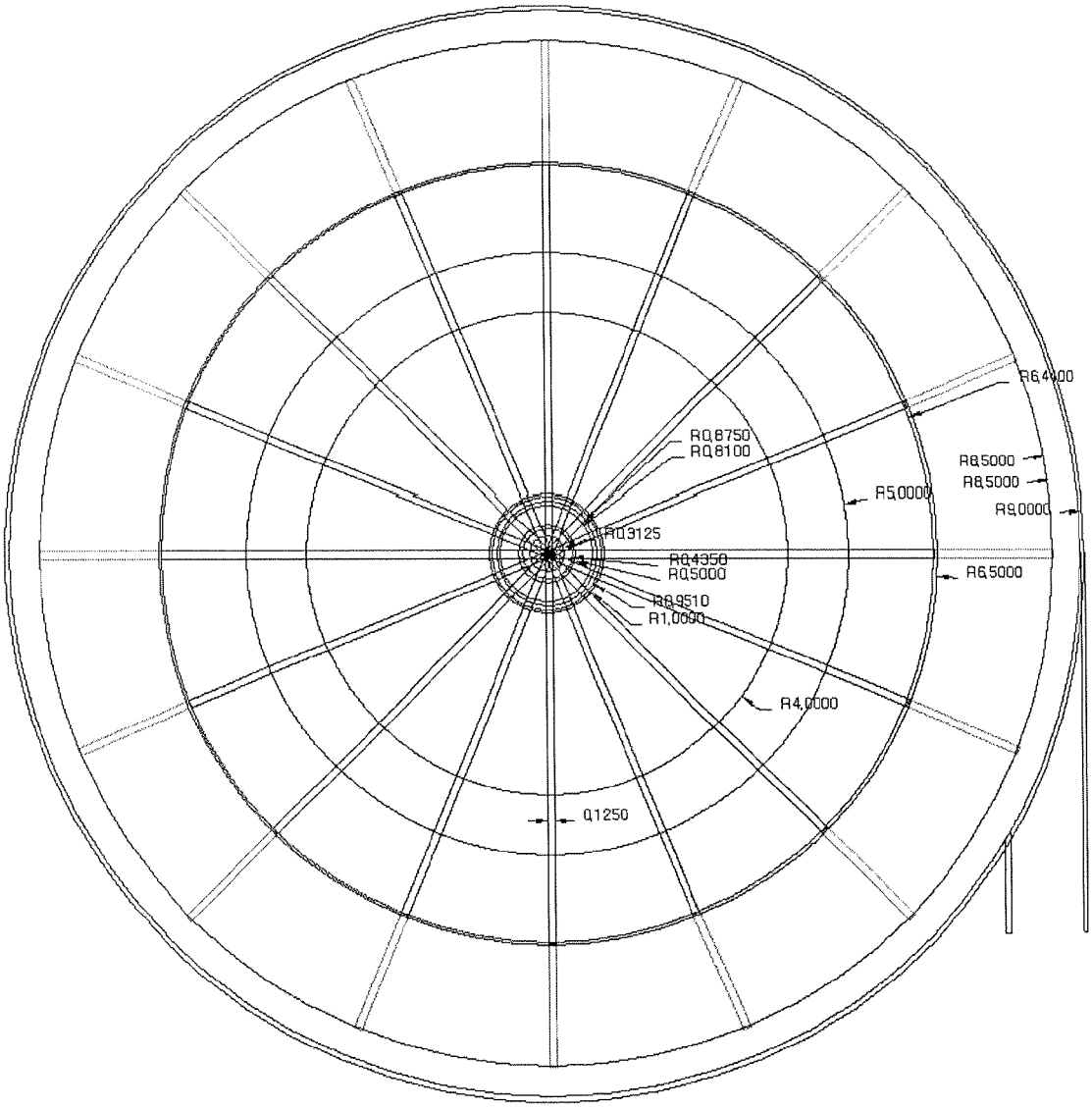
FIG. 4 is a top view of an exemplary embodiment of a rotating cone classifier of the present disclosure.
Figure 5:
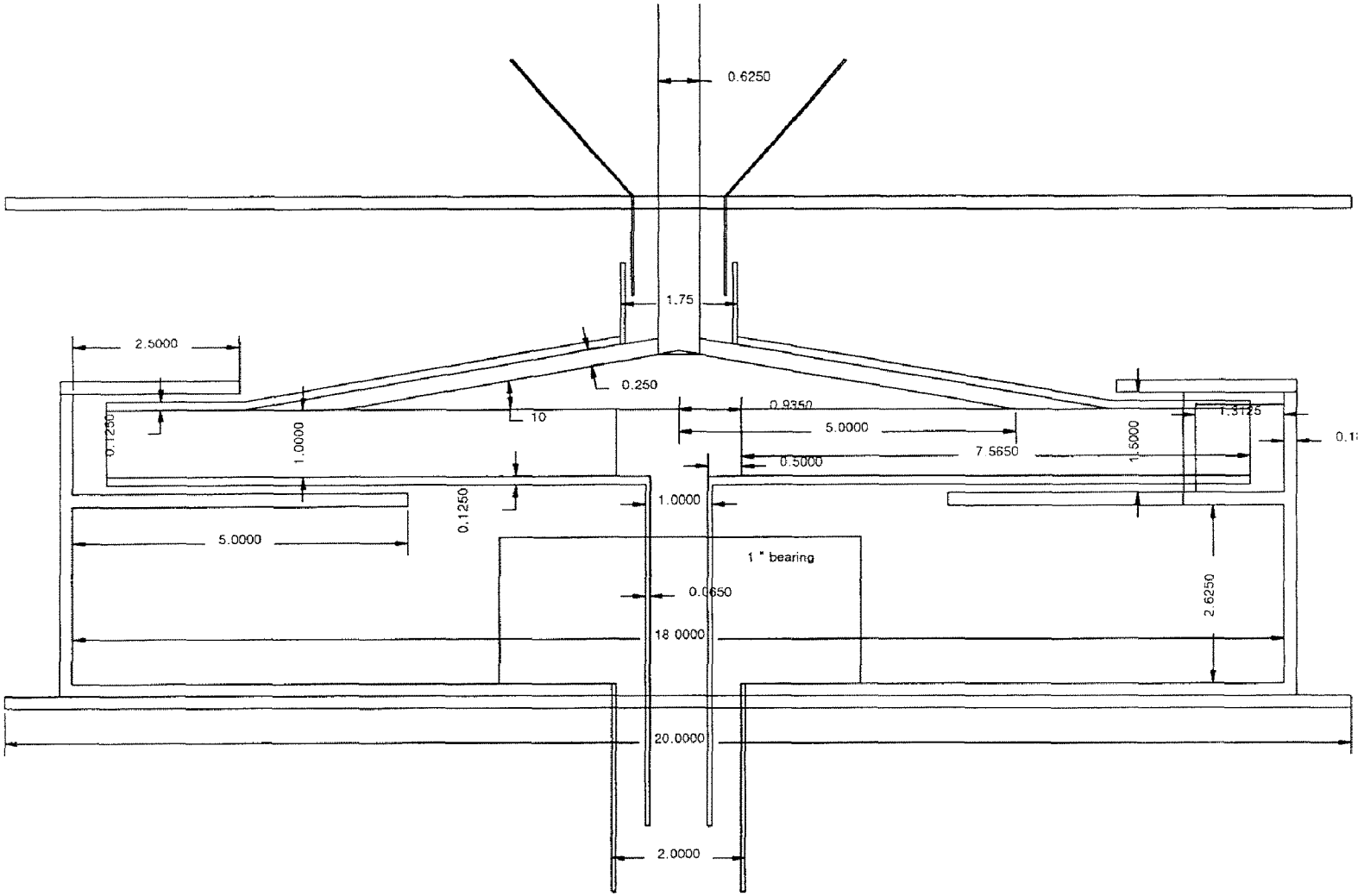
FIG. 5 is a side view of an exemplary embodiment of a rotating cone classifier of the present disclosure.
Figure 6A:
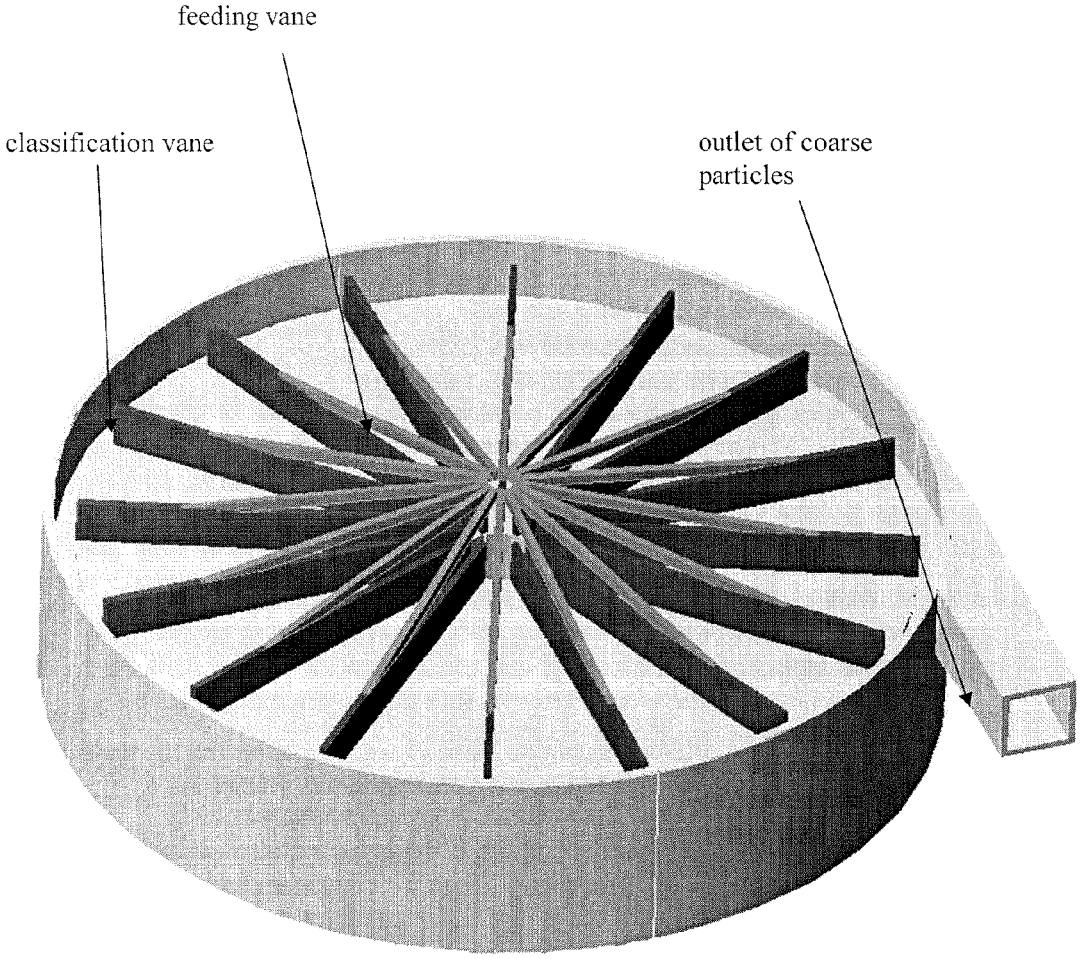
FIG. 6*a* is a perspective view of an exemplary embodiment of a rotating cone classifier of the present disclosure with the cover removed, showing the feeding and classification vanes.
Figure 6B:
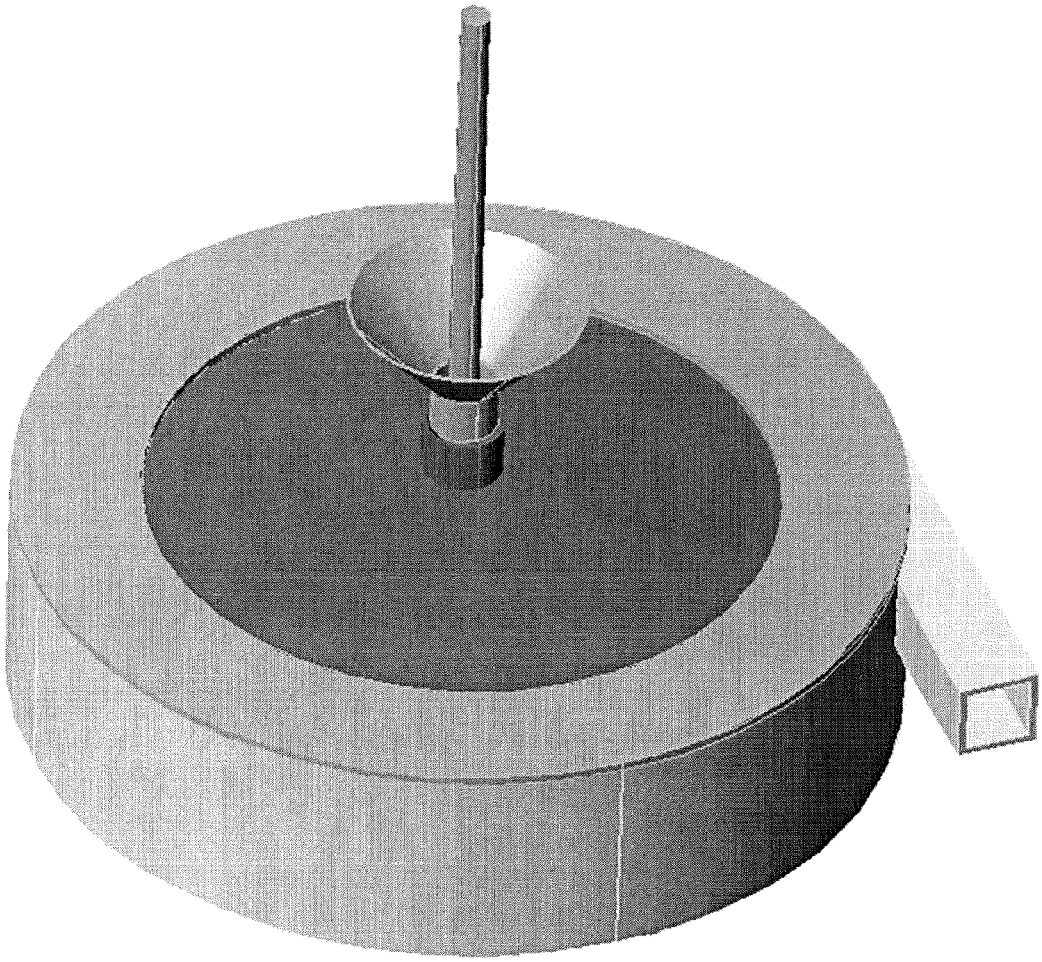

The following description should be read with reference to the drawings, in which like elements in different drawings are numbered in like fashion. The drawings, which are not necessarily to scale, depict selected illustrative embodiments and are not intended to limit the scope of the disclosure. Although examples of construction, dimensions, and materials are illustrated for the various elements, those skilled in the art will recognize that many of the examples provided have suitable alternatives that may be utilized.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a," "an," and "the" encompass embodiments having plural referents, unless the content clearly dictates otherwise. For example, reference to "a film" encompasses embodiments having one, two or more films. As used in this specification and the appended claims, the term "or" is generally employed in its sense including "and/or" unless the content clearly dictates otherwise.

Air classifiers are characterized by the cut size and cut sharpness they can provide. The efficiency for a particle of diameter d is defined as $$\text{efficiency}(d) = f_c \frac{q_C(d)}{q_F(d)} \tag{1}$$

where fc is the overall efficiency, i.e. mass of coarse particles/mass of feed particles, and $q_C(d)$ and $q_F(d)$ are the differential size distributions of the coarse fraction and feed. Cut size is most often defined as the particle size with 50% efficiency ($d_{50}$).

Cut sharpness is defined as $$\kappa_{25/75} = \frac{d_{25}}{d_{75}} \tag{2}$$

where $d_{25}$, $d_{75}$ are the particle diameters with 25, 75% efficiency. By this definition, and because the grade efficiency is a monotonically increasing curve, cut sharpness has value between 0 and 1.

In ideal conditions, classifiers would be able to perform a perfect separation. This means all particles below the cut size would leave with the air in the fine fraction, while all particles above the cut size would be collected as the coarse fraction.

In the ideal case, cut sharpness equals unity. However, classifiers do not produce such ideal results because of the random fluctuations in the flow field, particle-particle interactions, agglomerations, and variations in the forces acting on the particles with position in the classifier. Real separation processes have a cut sharpness smaller than 1.

Particle throughput, or mass flow rate into the classifier, affects both cut size and sharpness. The effect of throughput on cut size is not always clear, but in general cut sharpness decreases as throughput increases.

Some factors should be considered in classifier design. Small particles fall at a slower rate in air than large particles, larger particles have a greater centrifugal force in the flow inside a classifier than small particles. Smaller particles have less inertia and can change their direction of flow easier than larger particles. Larger particles require a higher conveying velocity than smaller particles. The probability of collision with a rotating blade is higher for larger particles than for smaller particles. In an exemplary embodiment a classifier is designed so that there is minimum material interference among the particles in the classification zone.

An exemplary embodiment of a rotating cone classifier of the present disclosure, shown in FIGS. 2-9, is a modification of a rotating vane classifier. This exemplary classifier minimizes particle attrition and provides good sharpness and easy control of cut size.

An exemplary embodiment of the Rotating Cone (RC) classifier contains two sets of vanes: feeding vanes and classification vanes. In one example, air or other fluid with feed particles is introduced through a funnel at the top of a rotating cone to feeding vanes, set at an angle of 10 degrees with respect to the classification vanes. It is understood that another angle of incline can instead be used.

The principle of this classifier is similar to the centrifugal rotating vane classifier in that it uses both drag force and centrifugal force created by rotation of the vanes, but differs in the way particles are introduced to the classification zone. In the feeding vanes, particles and air flow radially outwards and are carried directly into the middle of the classification vanes. In the classification vanes, particles are separated into opposite directions using two major forces: one is the drag force that carries the fine particles through the rotating vanes radially inward; the other is the centrifugal force that rejects the coarse particles to the outer wall.

Conventional rotating classifiers generate a forced vortex by rotating vanes, and air and particles enter from the outside of the vanes. The rotating vanes impact particles during classification, and the impact can cause significant particle attrition for fragile particles. In the exemplary rotating cone classifier, the entering particles are impacted at a very small radius—the inner radius of the feeding vanes instead of the outer radius—and hence by small centrifugal force. Therefore, particle attrition is significantly reduced and the classifier is able to handle fragile particles not amenable to classification with the conventional rotating vane classifiers.

An exemplary embodiment of the classifier uses 16 feeding vanes and 16 classification vanes. However, other numbers of vanes may also be used. Moreover, the number of feeding vanes need not equal the number of classification vanes.

Figure 7:
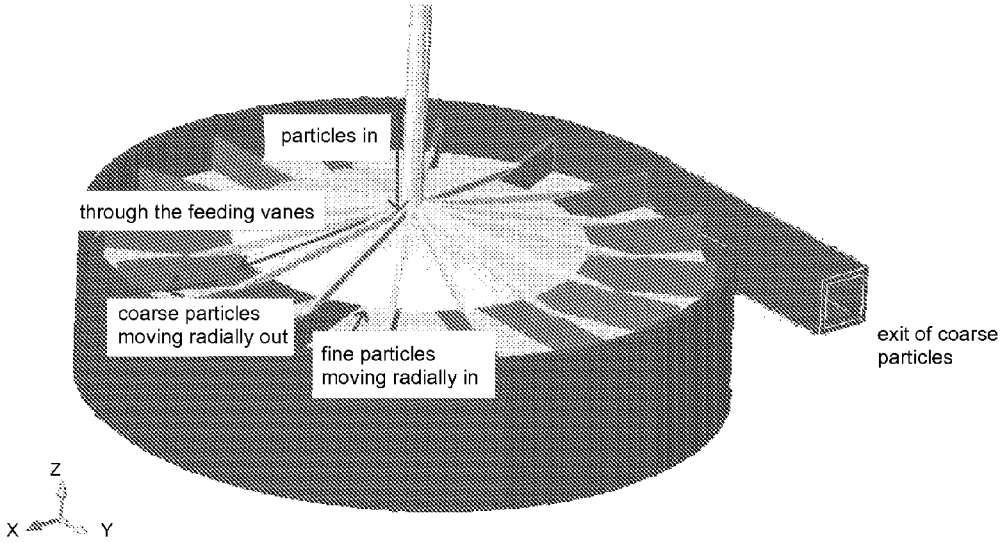
FIG. 7 is a schematic diagram of an embodiment of an open RC classifier, showing particle flow with respect to the feed surface, particle feeding vanes, classification surface and classification vanes.
Figure 8:
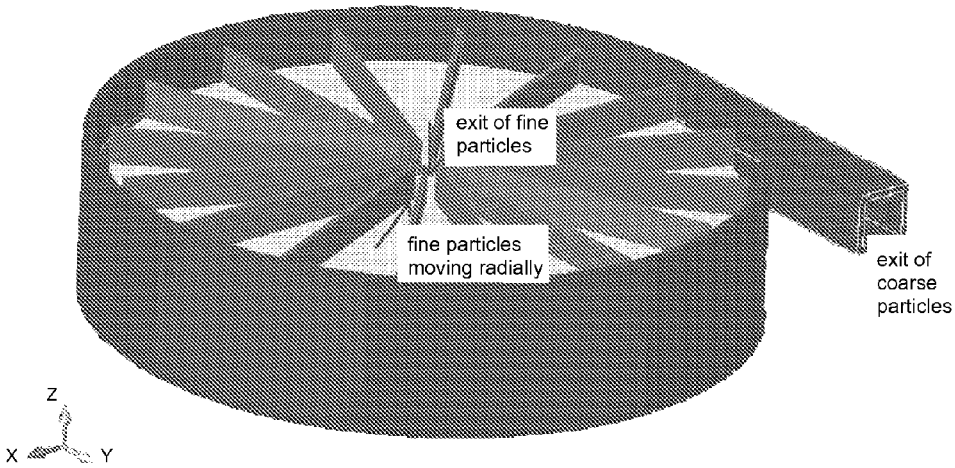
FIG. 8 is a schematic diagram of an embodiment of an open RC classifier, showing fine and coarse particle exits.
Figure 9:
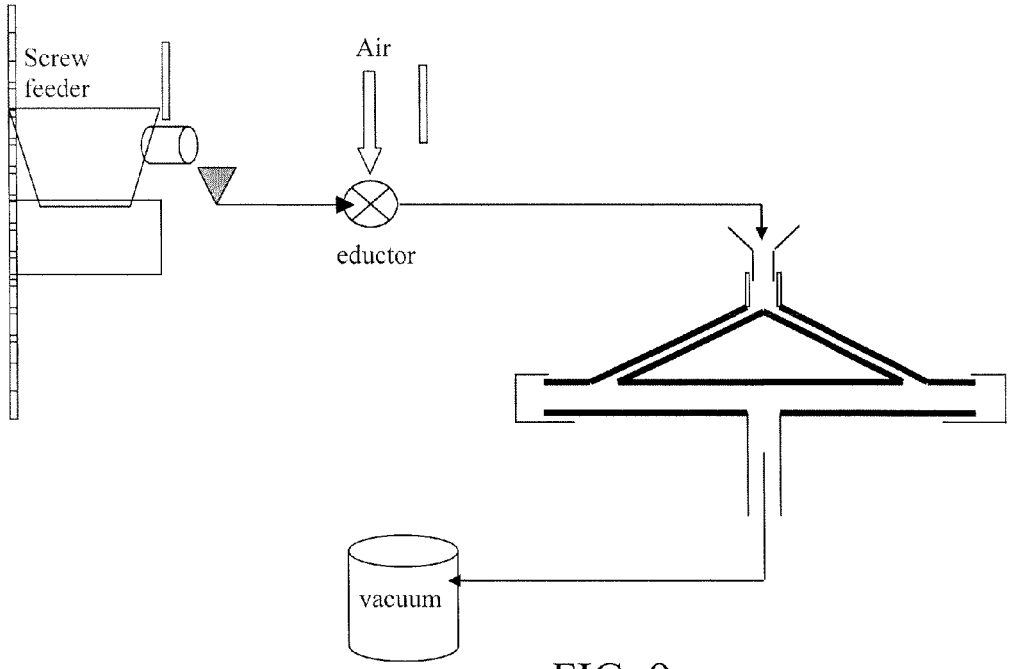
FIG. 9 is a schematic diagram of an exemplary embodiment of a rotating cone classifier system according to the present disclosure.

In an exemplary embodiment shown in FIGS. 7-9, the particles to be classified enter near the rotating shaft and move along the inclined feed surface while it rotates about the shaft. The particles are thereby introduced into the apparatus at a small centrifugal force, which increases as the particles move toward the periphery of the apparatus. After dropping off of the feed surface and into the classification vanes, the particles are separated by centrifugal force so that the coarse particles move radially outward and the fine particles move radially inward.

As shown in FIG. 9, particles are fed to the eductor from a screw feeder through the ⅜ inch plastic tube. Then the particles are introduced to the feeding vanes in the center of the classifier through the funnel and carried to the classification vanes by both the centrifugal force created by the rotation of the feeding vanes and the air flow from the eductor. Coarse particles are collected to a filter bag attached to the outlet, while fine particles are moved radially inwards through the classification vanes to a plastic exit pipe by vacuum, and then collected in a vacuum bag. The exit pipe has a small hole so that the air flow can be measured with an air flow meter. In one embodiment, a gate valve is attached to control the air flow.

In an exemplary embodiment, all particles are classified into two outlets: one in the center of the classifier for fine particles and the other in the outer radius of the classifier for coarse particles. The initial experiments were run at several different rotational speeds from 200 to 1500 rotations per minute (rpm) at a feed rate of 9 g/min to check the performance of the motor and for accumulation of particles inside the apparatus, for example. A powerful motor may be selected to maintain high rotational rates at a consistent speed.

Studies found that the classifier could accumulate mass inside the apparatus. All particles rejected by the rotating vanes are intended to go to the bag placed at the side exit pipe but many particles are instead carried through a gap between the lower disk of the classification vanes and the bottom, consequently accumulating inside the classifier. This may cause significant particle loss. This accumulation may be more pronounced at lower rotational speeds (sometimes up to 50%).

Figure 10A:
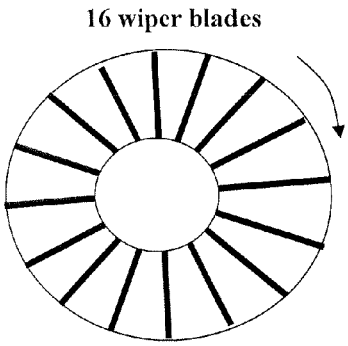
FIG. 10*a* is a cross-sectional schematic diagram showing another exemplary embodiment of a classifier, including a plurality of wiper blades.
Figure 10B:
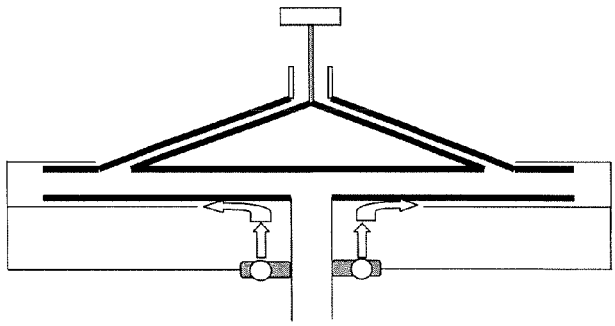
FIG. 10*b* is a top view of the embodiment shown in FIG. 10*a*.

Therefore, another exemplary embodiment of the classifier of the present disclosure shown in FIG. 10(*a*) includes placing and gluing a plurality of wiper blades diagonally between the lower surface of the classification vanes and the surface of the lower disk. In one example, sixteen blades were used, though more or fewer may also be used. The blades allowed more air to be pushed out radially and prevented the particles from being accumulated inside. Also, as shown in FIG. 10(*b*), two screws out of four were removed from the bottom of the apparatus to allow air to be drawn through the holes or orifices.

Figure 11:
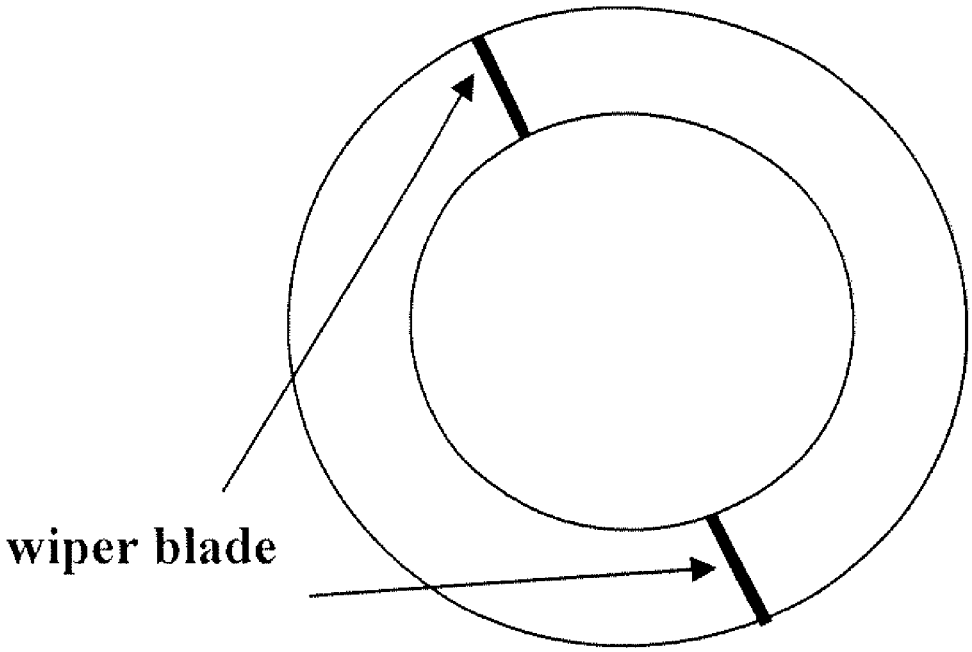
FIG. 11 is a schematic diagram showing another exemplary embodiment of a classifier including two wiper blades attached to the upper disk.

A study also found that some particles were coming out through the gap between the upper disk of the classification vanes and the top. This particle loss increases with increasing rotational speed. This type of particle loss can release dust to the air; inhalation of the dust might be harmful. To decrease or eliminate this particle loss, two wiper blades were placed diagonally and glued inside the disk in another embodiment, as shown in FIG. 11. This allows the air to be pushed out radially and prevents some dust from coming out through the gap.

Figure 12:
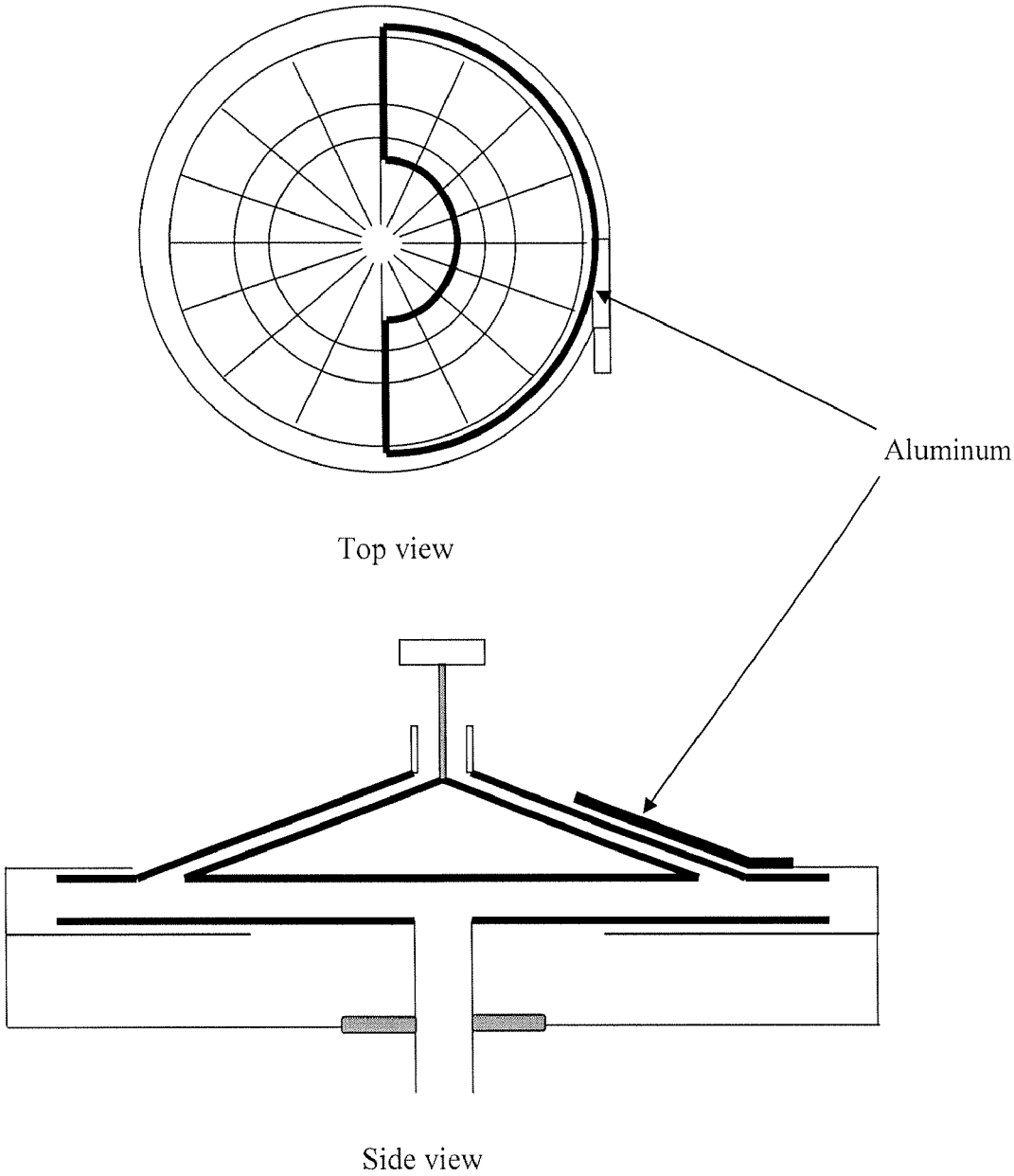
FIG. 12 is a schematic diagram showing another exemplary embodiment of a classifier including an aluminum plate.

However, at higher rotational speeds, some dust still escaped through the gap. Most of the dust escaping was observed in the right half part of the upper gap next to the coarse particle exit. This problem was resolved in yet another embodiment, by placing and taping an aluminum plate on that part, as shown in FIG. 12.

Another exemplary embodiment of a classifier of the present invention includes a dispersion mechanism, such as strings or a fan, positioned on the rotating shaft of the inlet. This dispersion mechanism is capable of dispersing the particles before they enter the feeding vanes. In one embodiment, rotating strings impact the entering particles slightly to disperse the agglomerates, but the tangential velocity of the strings will not be large enough to break the particles themselves. This modification increases cut sharpness because dispersed fine particles go to the fine fraction instead of being rejected to the coarse fraction as agglomerates.

Figure 13A:
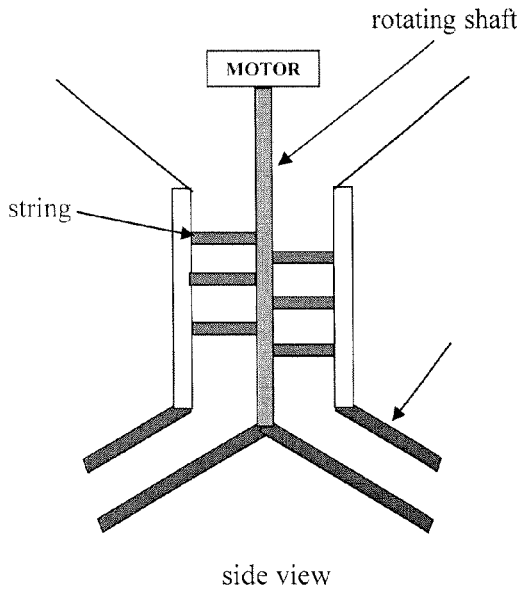
FIG. 13*a* is a top view of a schematic diagram showing another exemplary embodiment of a classifier, including a particle dispersion mechanism.
Figure 13B:
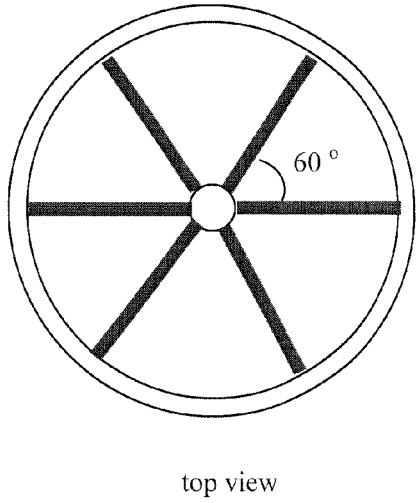
FIG. 13*b* is a cross-sectional view of the embodiment shown in FIG. 13*a*.
Figure 14:
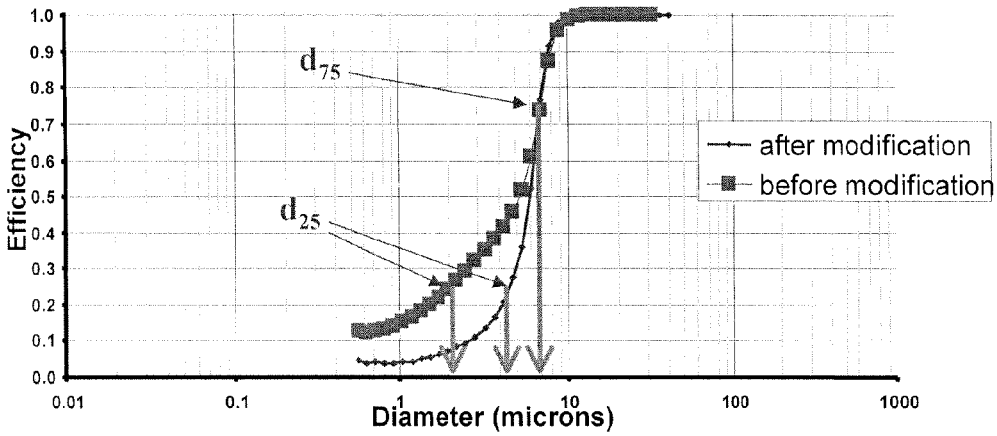
FIG. 14 is a graph showing comparison of efficiency curves at rpm=1500, airflow=60 cfm, feed rate=9 g/min.

One embodiment uses 6 plastic strings, such as cable ties, staggered on the shaft, as shown in FIG. 13. FIG. 13(*a*) shows a top view of the embodiment, and FIG. 13(*b*) shows a cross-sectional side view of the embodiment. Such a mechanism is simple and easy to install. Cut sharpness ($d_{25}/d_{75}$) significantly increases with use of the dispersion mechanism. For example, at 1500 rpm, 60 cfm and 9 g/min, sharpness increased from 0.29 to 0.65 because $d_{25}$ significantly increases from 2.1 to 4.4 while $d_{75}$ does not change, as shown in FIG. 14.

Figure 15:
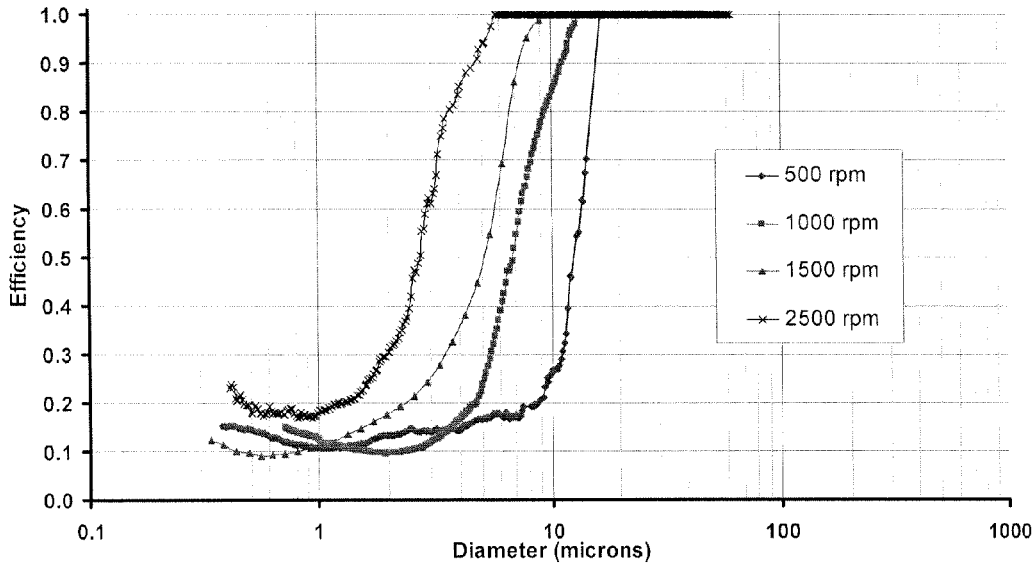
FIG. 15 is a graph of efficiency curves at four different rotational speeds at 60 cfm airflow, 9 g/min.
Figure 16:
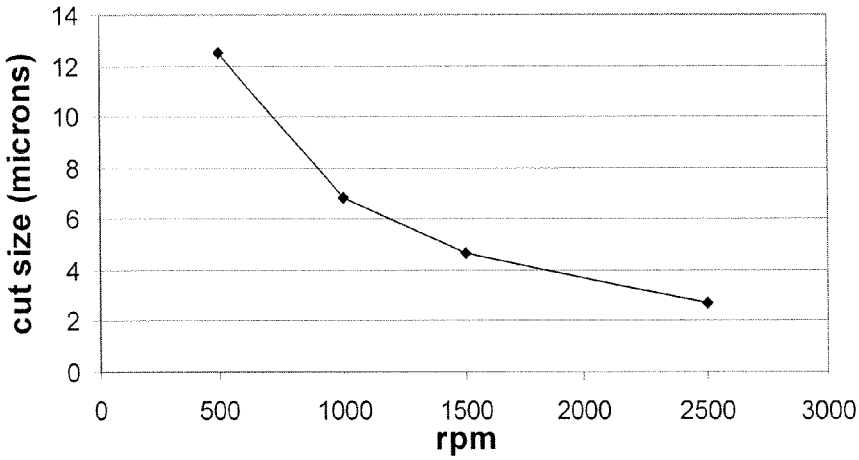
FIG. 16 is a graph of the effect of rpm on cut size at 60 cfm airflow, 9 g/min feed rate.

A classifier of the present disclosure was tested with ISO 12103-1, A2 Fine test dust at different rotational speeds between 500 and 2500 rpm. The cut size decreases with increasing rotational speed because the centrifugal force increases with rpm; this pushes more coarse particles to the bag placed at the side exit pipe. A downward trend of cut size with increasing rpm was exhibited, as shown in FIGS. 15 and 16. Thus, an operator can easily control the cut size by adjusting the rotational speed. As shown in FIG. 15, cut sizes between 3 microns and 12 microns are achievable by varying rotational speed. Moreover, the range of cut sizes can be extended by changing the air flow.

Figure 17:
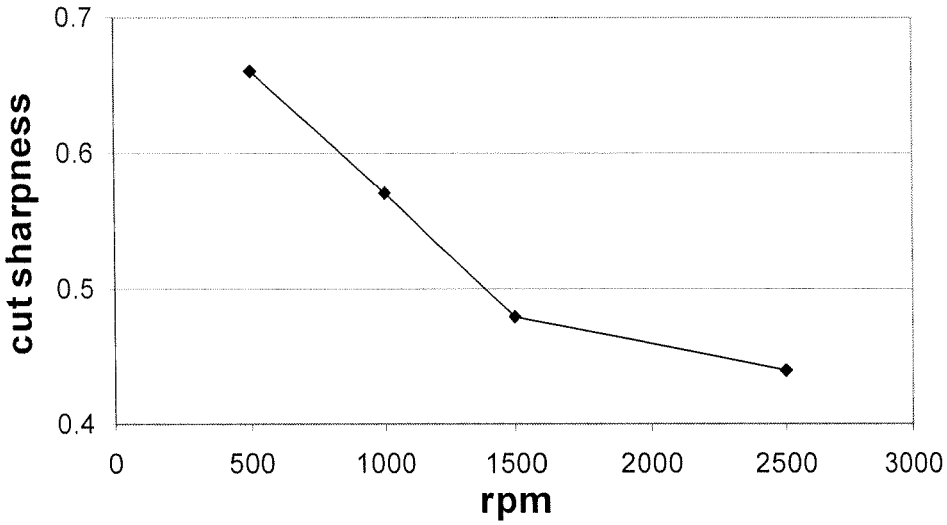
FIG. 17 is a graph of the effect of rpm on cut sharpness at 60 cfm airflow, 9 g/min feed rate.
Figure 18:
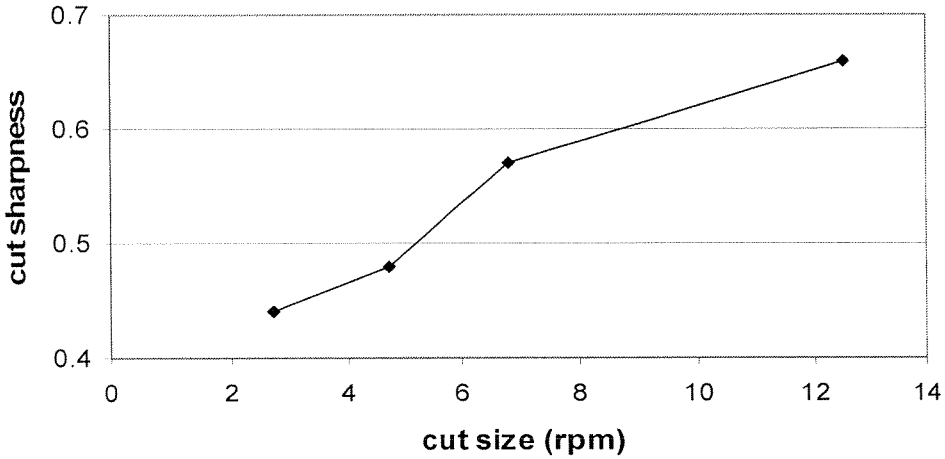
FIG. 18 is a graph of the effect of cut size on cut sharpness at 60 cfm airflow, 9 g/min feed rate.

A series of experiments at 60 cfm showed that over the experimental conditions cut sharpness (d25/d75 ratio) varies from 0.45 to 0.67 and generally becomes lower at lower cut sizes. FIG. 17 shows a downward trend as rpm increases. In general, as shown in FIG. 18, cut sharpness decreases with decreasing cut size because agglomeration increases at lower cut size.

Cut sizes and efficiencies at low rpm may not be as accurate and consistent as at high rpm. This is because the centrifugal force created by slowly rotating vanes is not enough to send all coarse particles to the exit, so some particles are accumulated around the outside of the vanes. In one example, after each run, particles are washed out at high rpm, collected in a pre-weighed bag and regarded as coarse particles. Accumulation of particles increases with decreasing rotational speed.

Figure 19:
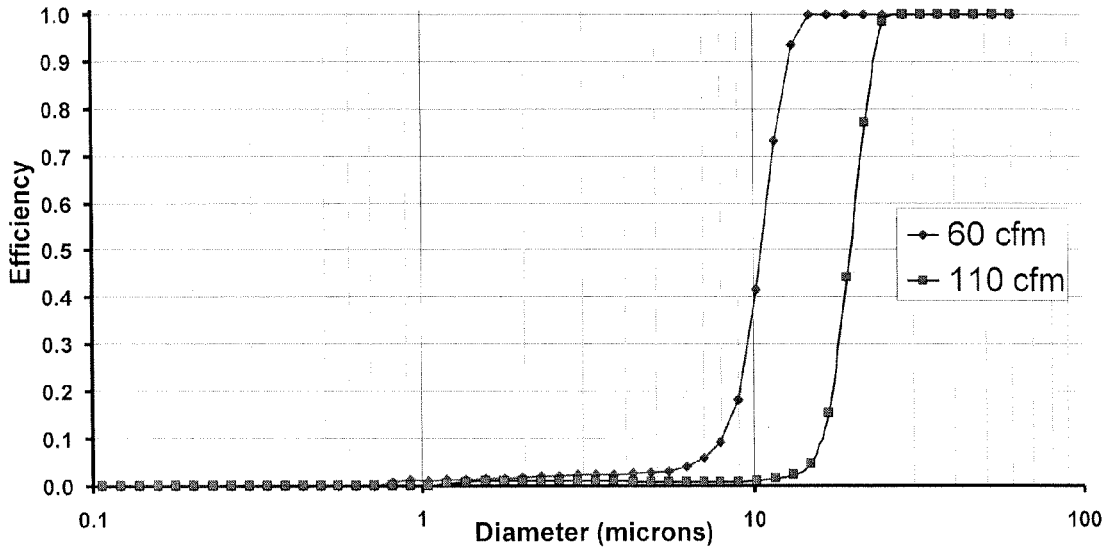
FIG. 19 is a graph of the efficiency curves at two different airflows at 500 rpm, 9 g/min particle loading.
Figure 20:
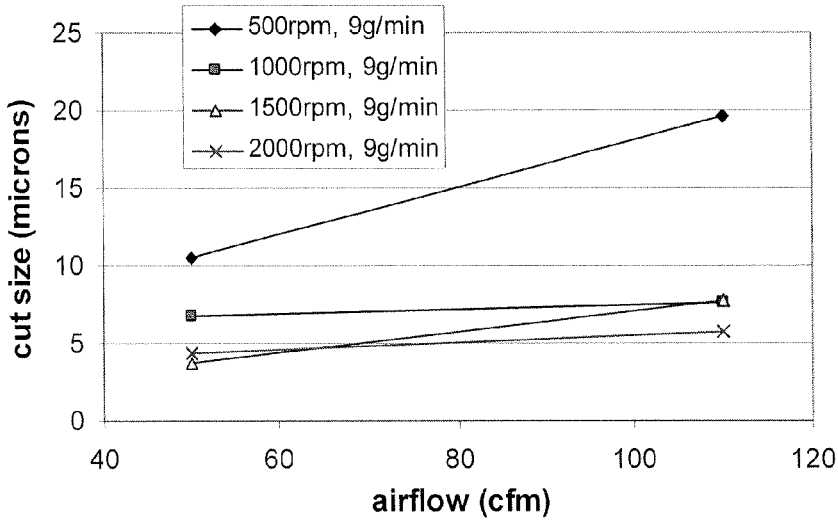
FIG. 20 is a graph of the effect of airflow on cut size at 60 cfm airflow, 9 g/min feed rate.

An exemplary embodiment of a RC classifier of the present disclosure provides excellent sharp efficiencies, as shown in FIG. 19. FIG. 20 shows that higher air flow gives higher cut size. The drag force increases with increasing air flow and this sends more particles to the fine fraction.

Cut sharpness (0.79) at 60 cfm of FIG. 19 is better than cut sharpness (0.67) at 60 cfm, 9 g/min of FIG. 15 even though the two experiments were conduced on the identical experimental conditions. The difference between the results may be attributed to the Aerosizer used in each experiment. The former used an old one; the latter used a new one.

Figure 21:
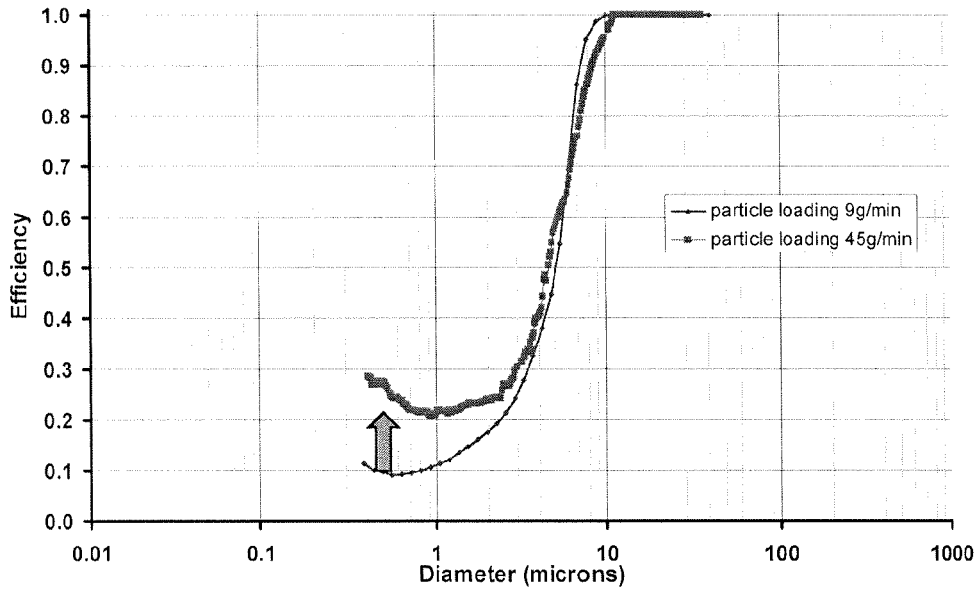
FIG. 21 is a graph of the efficiency curves at two different particle loadings at 1500 rpm, 60 cfm airflow.
Figure 22:
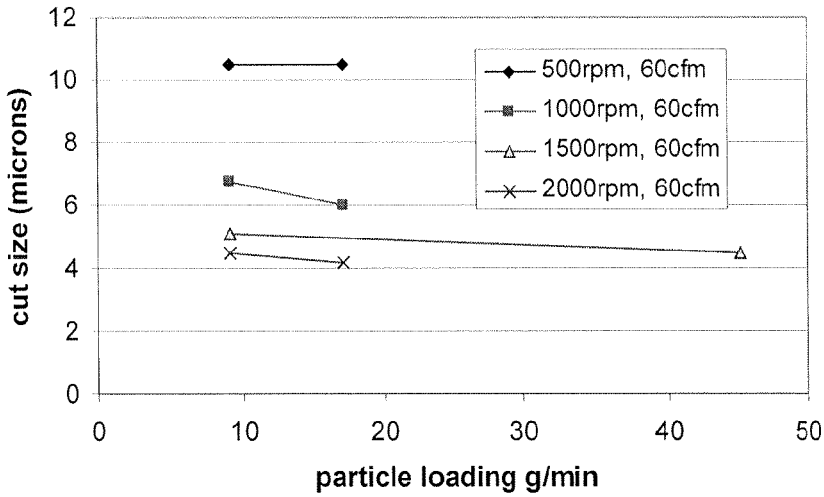
FIG. 22 is a graph of the effect of particle loading on cut size at 60 cfm airflow.
Figure 23:
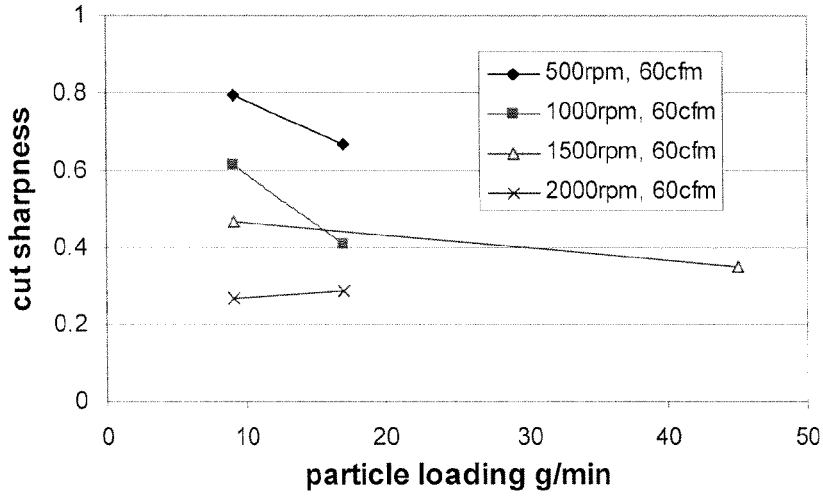
FIG. 23 is a graph of the effect of particle loading on cut sharpness at 60 cfm airflow.

The effect of particle loading in classification performance is not clear. But, in general both cut size and sharpness decrease as particle loading increases, as shown in FIGS. 22 and 23. FIG. 21 shows that the hook effect in particles less than 1 micron increases and cut sharpness decreases from 0.47 to 0.35 as particle loading increases from 9 to 45 g/min. One of the reasons that cut sharpness decreases may be particle agglomeration.

In an exemplary embodiment, ideally all particles are separated into two fractions in the classification vanes after leaving the feeding vanes, but computational fluid dynamics (CFD) modeling predicts that particle laden flow passing the feeding vanes pushes air outwards in the classification vanes. This causes some particles to reach the edge of the unit directly without being classified. Consequently, even very small particles may go to the edge and end with the coarse fraction instead of being classified to the fine fraction.

Figure 24:
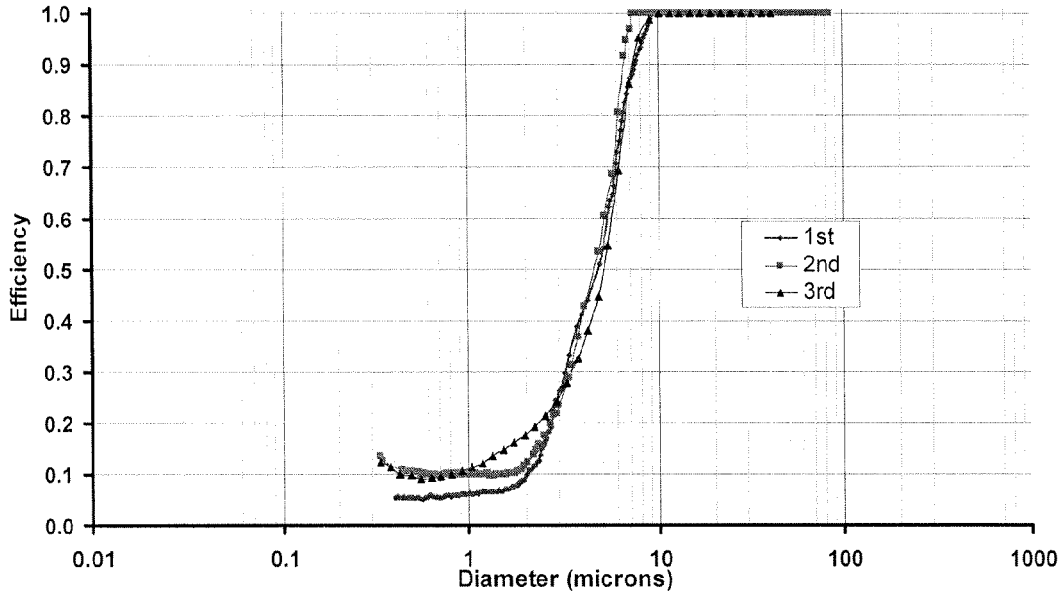
FIG. 24 is a graph of the efficiency curves repeated 3 times at 1500 rpm, 60 cfm airflow, 9 g/min feed rate.

In an exemplary embodiment, a classifier of the present disclosure exhibits reproducibility, in that it consistently provides the same performance, i.e. same cut size and sharpness, at repeated experiments for identical operating conditions. FIG. 24 shows efficiency curves when experiments were repeated three times, showing reasonable reproducibility.

The results in TABLE 1 indicate that there is not much difference between performance of triplicated experiments. Therefore, cut size should be controlled and predicted very accurately once experiments are conducted by varying parameters.

TABLE 1

Cut size and sharpness of 3 experiments for identical operating conditions

| | 1st | 2nd | 3rd |
|---|---|---|---|
| Cut size (microns) | 4.7 | 4.5 | 5.1 |
| Cut sharpness | 0.48 | 0.51 | 0.47 |

Figure 25:
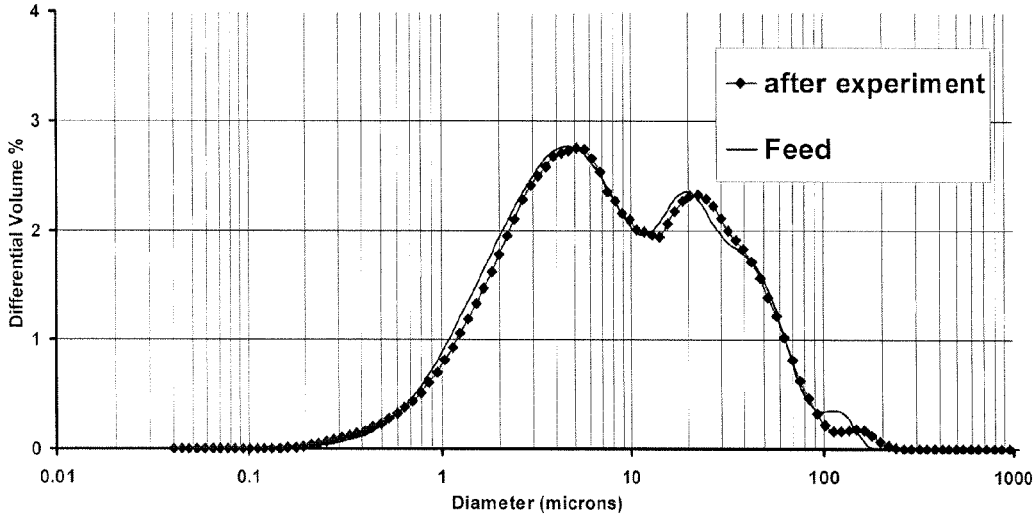
FIG. 25 is a graph of particle size distributions before and after classification with a classifier of the present disclosure.

An advantage of the RC classifier of the present disclosure is a significant reduction of particle attrition. The number of fine particles increases while the number of coarse particles decreases if particle attrition is significant. FIG. 25 shows the particle size distributions of the feed and of the union of the coarse and fine products from a run at 1500 rpm, 60 cfm airflow and 9 g/min particle loading. There is not much difference in the size distributions. This shows that the RC classifier succeeds in providing classification with minimal particle attrition.

Figure 26:
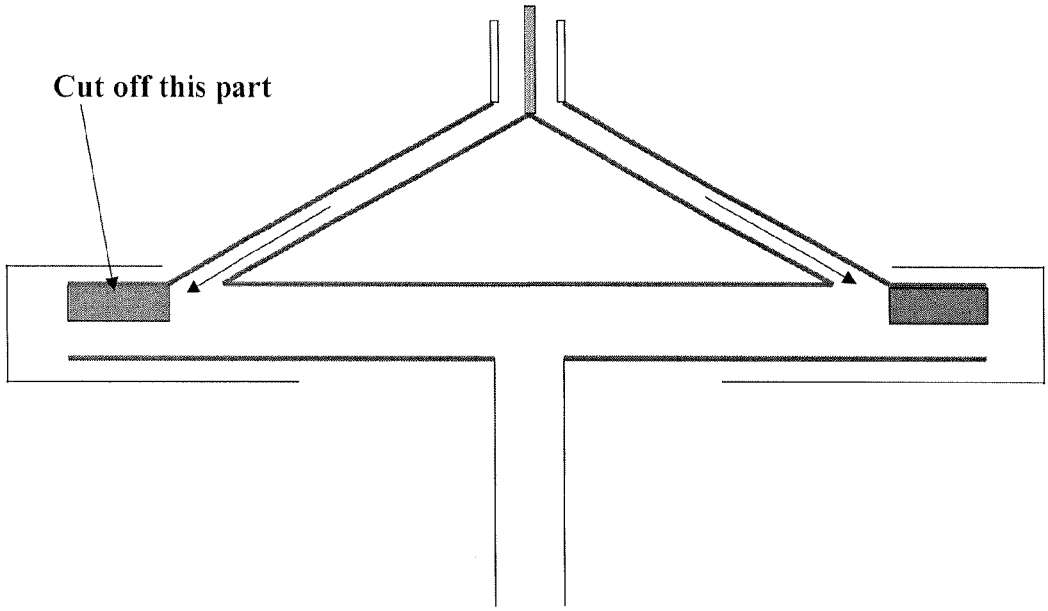
FIG. 26 is a schematic diagram of another embodiment of a RC classifier with the upper and outer part of the classification vanes removed.

In another exemplary embodiment, a RC classifier of the present disclosure is modified by cutting off the upper and outer part of the classification vanes, as shown in FIG. 26. This modification allows air to come from the outside of the classification vanes to the cutoff region with no vane and reduces the bypass of fine particles.

Figure 27:
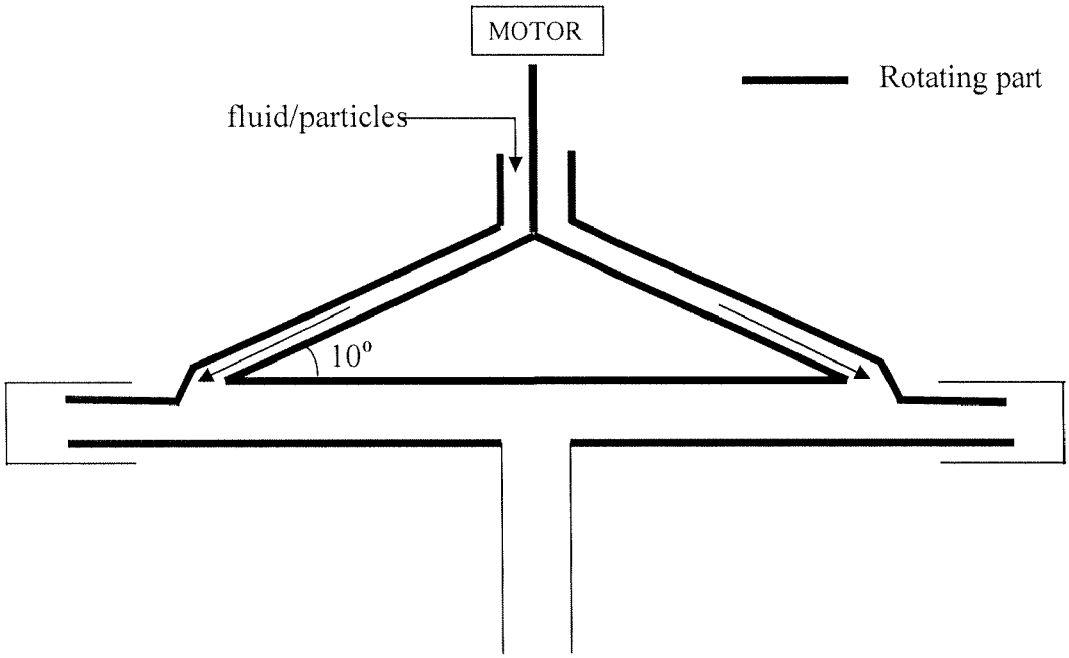
FIG. 27 is a schematic diagram of another embodiment of a RC classifier with a barrier.

In another exemplary embodiment, a RC classifier of the present disclosure includes a barrier as shown in FIG. 27. Numerical simulations show that performance can be improved by placing a barrier that prevents a direct path from the feeding vanes to the course exit. A way to achieve this is to modify the junction between feeding and classifying vanes as shown in FIG. 27.

Figure 28:
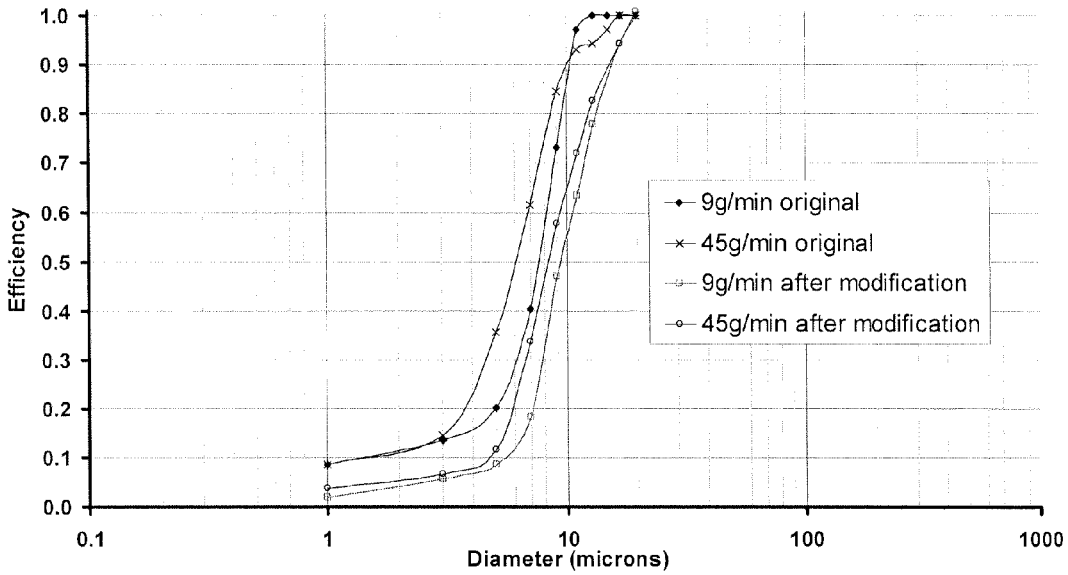
FIG. 28 is a graph of predicted efficiency curves before and after removing the upper and outer part of the classification vanes, for 1000 rpm and 110 cfm airflow.

FIG. 28 and TABLE 3 show that both cut size and sharpness increase after the modification of FIG. 26. In particular, efficiency curves for small particle diameters become lower.

TABLE 3

Comparison of efficiencies before and after modification

| Feed rate | Cut size (microns) before/after | Cut sharpness before/after |
|---|---|---|
| 9 g/min | 7.6/9.3 | 0.59/0.60 |
| 45 g/min | 6.1/8.3 | 0.49/0.54 |

In conclusion, an exemplary embodiment of an RC classifier of the present disclosure reduces particle attrition significantly by introducing particles into the classification zone near the center of rotation; thereby, the entering particles are impacted at a very small radius. With ISO 12103-1. A2 fine test dust, cut sizes in the range of 3-20 microns were obtained while maintaining a sharp cut. The test showed a clear downward trend of cut size with increasing rpm and decreasing airflow. Thus, cut size can be easily controlled by adjusting the rotational speed and airflow. In general, cut sharpness decreases with increasing particle loading due to particle agglomeration.

In one embodiment, the inlet of the RC classifier acts as a particle disperser. In one example, plastic strings are attached to the rotating shaft. Rotating strings will slightly impact the entering particles through the funnel and disperse the agglomerates. This modification significantly increases cut sharpness from 0.29 to 0.65 under the conditions of 1500 rpm disk speed, an airflow of 60 cfm, and a feed rate of 9 g/min. This is because dispersed fine particles go to the fine fraction instead of being rejected to the coarse fraction as agglomerates.

The following example includes exemplary materials and processing conditions in accordance with different embodiments of the disclosure. The example is not intended to limit the disclosure but rather is provided to facilitate an understanding of the invention as well as to provide examples of materials particularly suited for use in accordance with the various above-described embodiments.

EXAMPLE 1

Feed is loaded in a screw feeder. The amount of ISO Fine test dust in the screw feeder has a significant effect on the feed rate; therefore, the feed rate is measured before and after each run. The feed rate is adjusted by collecting the feed for two minutes. The feed rate is measured before and after every run. A pre-weighed vacuum bag that holds the fine particles is placed inside a vacuum cleaner. Another vacuum bag is pre-weighed to hold the coarse particles, and this is placed at the outlet.

The motor is turned on (for spinning vanes). The vacuum cleaner is turned on. The air for the eductor is turned on. The motor is adjusted to the desired speed. The rotating speed is measured using a tachometer to confirm that the speed setting is correct. The airflow is measured using the airflow meter and adjusted to the desired flow rate. A funnel is placed underneath the exit of the screw feeder where the feed enters and runs down the tube leading into the classifier.

The screw feeder is turned on. To prevent the feed from accumulating, the funnel is tapped continuously. The classifier is tapped continuously to prevent the particles from agglomerating during the run. After 20 minutes, the feeder is shut off. The other components are left on for about 30 seconds to allow more tapping and to allow time for all the particles be classified. The air, motor, and the vacuum are then shut off. The vacuum bags are removed and weighed. Samples are taken to be analyzed using the Aerosizer.

The classifier was tested using ISO 12103-1, A2 Fine Test Dust manufactured by Powder Technology. Inc. It has nominal size from 0 to 80 microns ($d_{10}$=1.5, $d_{50}$=7.5 microns and $d_{90}$=42.5 microns).

This material is the second one of the four grades (smallest A1-largest A4) of test dust called Arizona test dust. The chemical composition is shown in TABLE 4.

TABLE 4

Chemical composition of the feed material

| Chemical | % of Weight |
|---|---|
| $SiO_2$ | 68-76 |
| $Al_2O3$ | 10-15 |
| $Fe_2O3$ | 2-5 |
| $Na_2O$ | 2-4 |
| CaO | 2-5 |
| MgO | 1-2 |
| $TiO_2$ | 0.5-1.0 |
| $K_2O$ | 2-5 |

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application. For example, the described and shown features can be used in any combination on a particular apparatus.

We claim:

1. A classifier comprising:

a central particle inlet;

a coarse particle outlet;

a fine particle outlet;

a conical feed surface comprising an upper apex and a lower base;

a plurality of particle feeding vanes disposed on the feed surface, wherein the plurality of particle feeding vanes rotate together with the feed surface about a central axis of rotation;

a classification surface disposed below the feed surface such that the classification surface is disposed closer to the lower base of the feed surface than it is to the upper apex of the feed surface, wherein the classification surface is approximately perpendicular to the central axis of rotation; and a plurality of classification vanes disposed on the classification surface, wherein the plurality of classification vanes rotate together with the classification surface about the central axis of rotation;

wherein the classifier is configured such that particles to be separated enter the classifier through the central particle inlet near the central axis of rotation and flow radially outward on the feed surface to the classification surface.

2. The classifier of claim 1, wherein the feed surface is inclined at an angle of about 5 to 15 degrees with respect to the classification surface.

3. The classifier of claim 1, further comprising a particle dispersion mechanism.

4. The classifier of claim 3, wherein the particle dispersion mechanism comprises a plurality of strings attached to a rotating shaft at the inlet.

5. The classifier of claim 1, wherein a number of particle feeding vanes equals a number of classification vanes.

6. The classifier of claim 1, further comprising:

an interior bottom surface; and a plurality of wiper blades positioned between the classification surface and the interior bottom surface.

7. The classifier of claim 6, further comprising an orifice in the interior bottom surface.

8. The classifier of claim 1, further comprising:

a top surface; and a plurality of wiper blades positioned between the classification surface and the top surface.

9. The classifier of claim 1, wherein the classifier further comprises a barrier that prevents a direct path from the feeding vanes to the coarse outlet.

* * * * *